US007854601B2

(12) United States Patent
Wagner

(10) Patent No.: US 7,854,601 B2
(45) Date of Patent: Dec. 21, 2010

(54) LUBRICANT-TIGHT VANE ROTARY VACUUM PUMP

(75) Inventor: Juergen Wagner, Mueschenbach (DE)

(73) Assignee: Pfeiffer Vacuum GmbH, Asslar (DE)

( * ) Notice: Subject to any disclaimer, the term of this patent is extended or adjusted under 35 U.S.C. 154(b) by 427 days.

(21) Appl. No.: 12/001,892

(22) Filed: Dec. 12, 2007

(65) Prior Publication Data

US 2008/0145209 A1 Jun. 19, 2008

(30) Foreign Application Priority Data

Dec. 13, 2006 (DE) ..... 10 2006 058 837

(51) Int. Cl.
*F03C 2/00* (2006.01)
*F04C 2/00* (2006.01)
*F04C 23/00* (2006.01)

(52) U.S. Cl. ..... 418/13; 418/88; 418/96; 418/259; 418/270; 417/281; 417/295

(58) Field of Classification Search ..... 418/13, 418/85, 88, 96–100, 259, 270; 184/6.16; 417/281, 295
See application file for complete search history.

(56) References Cited

U.S. PATENT DOCUMENTS 3,838,950 A * 10/1974 Andriulis ..... 418/96
4,276,005 A * 6/1981 Bassan ..... 418/13
4,483,667 A * 11/1984 Berges et al. ..... 418/88
4,898,521 A 2/1990 Sakurai et al.
4,968,223 A 11/1990 DaCosta
5,232,355 A 8/1993 Fujii et al.
2005/0260082 A1 11/2005 Conrad et al.

FOREIGN PATENT DOCUMENTS

DE 4443387 1/1996
DE 102004024554 A1 * 12/2005
JP 60090998 A * 5/1985 ..... 418/13

* cited by examiner

*Primary Examiner*—Theresa Trieu
(74) *Attorney, Agent, or Firm*—Abelman, Frayne & Schwab

(57) ABSTRACT

A lubricant-tight vane rotary vacuum pump includes at least one pump stage (17, 18) having a safety valve (3) for controlling gas flow to the pump stage, a lubricant pump, a lubricant reservoir (30) at least partially surrounding the pump stage housing (10, 40), and a hydraulic conduit (31) connecting the lubricant pump outlet (22) with the safety valve (3), with a pressurized lubricant flow through the hydraulic conduit (31) opening the safety valve (3), and a channel (32) branching from the hydraulic conduit (31) for delivering a pressurized lubricant into the lubricant reservoir (30).

4 Claims, 2 Drawing Sheets

LUBRICANT-TIGHT VANE ROTARY VACUUM PUMP

BACKGROUND OF THE INVENTION

1. Field of the Invention

The present invention relates to a lubricant-tight vane rotary vacuum pump that includes at least one pump stage having a pump stage housing, a safety valve for controlling gas flow to the pump stage housing, a lubricant pump having an inlet and an outlet, a lubricant reservoir at least partially surrounding the pump stage housing, and a hydraulic conduit connecting the lubricant pump outlet with the safety valve, with a pressurized lubricant flow through the hydraulic conduit opening the safety valve.

2. Description of the Prior Art

A vane rotary vacuum pump of the type described above is disclosed in German Publication DE-OS 10 204 024 554 in which the lubricant, among others, is used for opening a hydraulically operated safety valve. The safety valve opens as soon as a lubricant pump, which is driven by the pump shaft, pressurizes the lubricant fed to the safety valve.

The lubricant also serves for lubricating the vanes which are arranged in the compression chamber of the vacuum pump and the rotation of which produces a pumping effect. Simultaneously, the lubricant seals the gaps between the vanes, the shaft and the compression chamber housing. This housing, which forms the pump stage housing, is submerged in a lubricant reservoir and is, therefore, surrounded by the lubricant over a major portion of its periphery. The heat, which is generated within the pump stage housing, is transmitted to the lubricant surrounding the housing.

The problem with this type of vacuum pumps consists in that the lubricant is heated progressively, whereby its chemical structure changes.

Accordingly, an object of the invention is to provide a vane rotary vacuum pump in which overheating of the lubricant is prevented.

SUMMARY OF THE INVENTION

This and other objects of the present invention, which will become apparent hereinafter, are achieved by providing, in the vane rotary vacuum pump, a channel branching from the hydraulic conduit for delivering a pressurized lubricant into the lubricant reservoir.

The pressurized lubricant flow insures that the lubricant in the reservoir does not remain static but is displaced. The lubricant movement insures that the lubricant, which contacts the pump stage housing, is displaced away from it and contacts other pump components which are surrounded by the lubricant reservoir, transmitting the acquired heat to these parts. Thereby, lubricant overheating is prevented.

According to an advantageous embodiment of the present invention, a shaft extends through the pump motor and the at least one pump stage and the lubricant pump is arranged on the shaft between the motor and the at least one stage.

The arrangement of the lubricant pump between the motor and the pump stage reduces the length of the hydraulic conduit that connects the lubricant pump outlet with the safety valve, as the safety valve, as a rule, is arranged in the vicinity of the motor.

According to further development of the present invention, a lubricant flow resistance is located between the lubricant pump and the pump stage. The flow resistance reduces the amount of pressurized lubricant that flows to the pump stage.

According to a further advantageous embodiment of the present invention, there is provided a slide bearing for supporting the shaft and located between the lubricant pump and the at least one stage.

As a result of its arrangement, the slide bearing can be lubricated by lubricant that leaves the lubricant pump. The bearing-lubricating lubricant is not the lubricant that directly leaves the lubricant pump outlet, but rather the lubricant that leaks through a gap between the housing and the shaft. A further advantage of this arrangement of the bearing consists in that even a relatively small sealing of the lubricant pump suffices, which substantially simplifies the construction of the pump and reduces costs.

According to a still further advantageous embodiment of the present invention, the lubricant pump outlet is located on a side of the shaft adjacent to an adjusting surface of the pump. With respect to the gravity force, in the embodiment of the pump shown in the drawings, the lubricant pump outlet is located beneath the shaft axis. This location of the lubricant pump outlet facilitates mounting and arrangement of the branching channel.

According to yet another embodiment of the present invention, the branching, from the hydraulic conduit, channel opens into the lubricant reservoir at a height between the shaft axis and the adjusting surface of the vacuum pump. This opening of the branching channel insures that the pressurized lubricant flows into the reservoir between the surface of the lubricant located in the lubricant and the bottom. This improves excitation in all of the regions of the lubricant reservoir, facilitating heat exchange.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The drawings show.

In the drawings the same parts are designated with the same reference numerals.

DETAILED DESCRIPTION OF THE PREFERRED EMBODIMENTS

Figure 1:
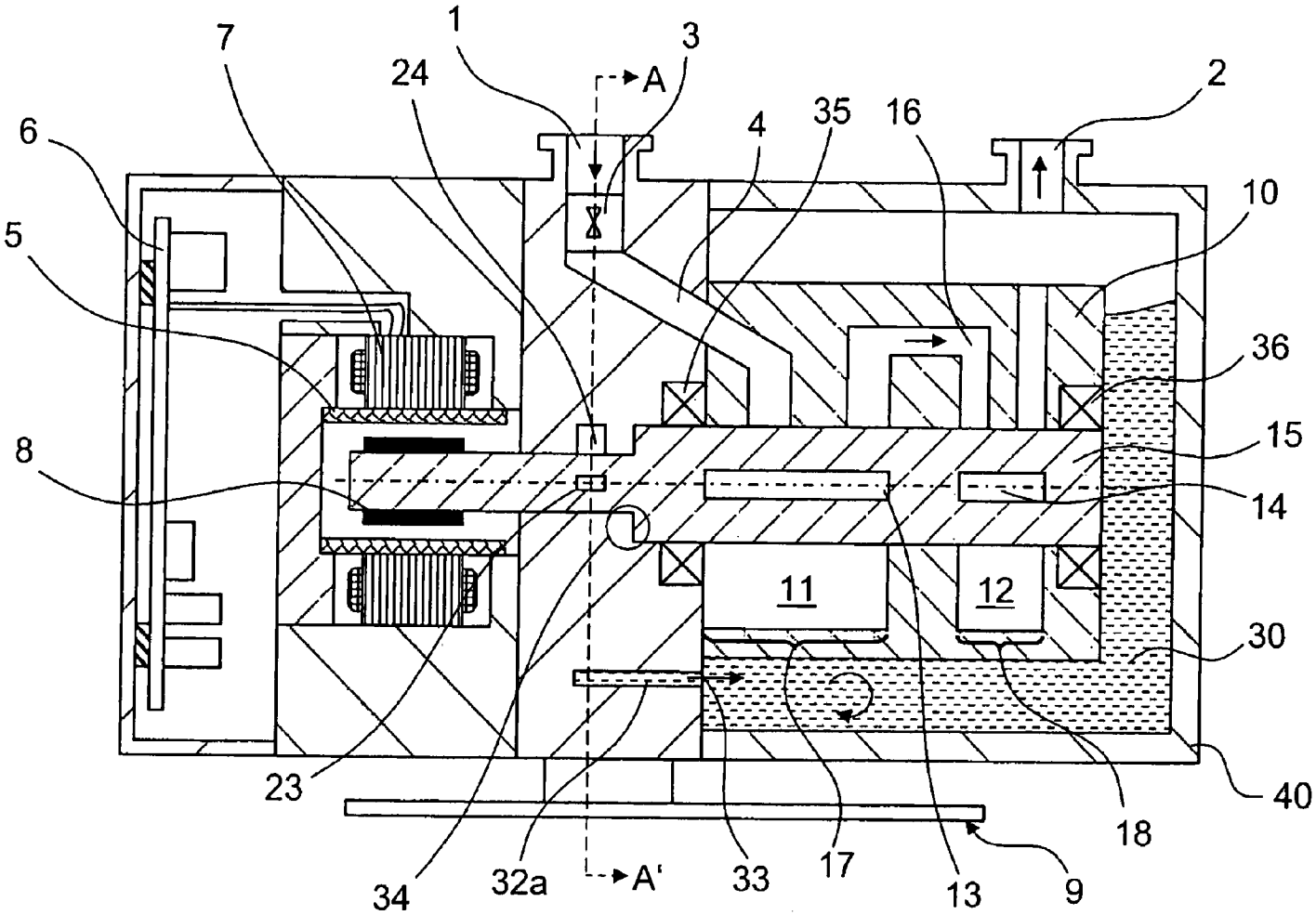
FIG. 1 a vertical cross-sectional view of a vane rotary vacuum pump according to the present invention along a shaft axis.

A lubricant-tight vane rotary vacuum pump according to the present invention, further, in short, vacuum pump, which is shown in FIG. 1, has a gas inlet 1 through which gas enters the vacuum pump, and a gas outlet 2 through which the compressed gas is discharged after being compressed in the pump interior. In the direction of the gas flow, a safety valve 3 is located immediately behind the gas inlet 1. The safety valve 3 is hydraulically operated by the vacuum pump lubricant that becomes operative as soon as the vacuum pump is under pressure, opening the safety valve 3. A gas conduit 4 connects the safety valve 3 with the compression chamber 11 of the first pump stage 17, so that the gas can reach the compression chamber 11 as soon as the safety valve 3 opens. The pump stage 17 is located in a pump stage housing 10 that is surrounded, at least partially, by lubricant contained in a lubricant reservoir 30. A vane 13 is rotatably supported in the cylindrical compression chamber 11. The vane 13 is rotated as a result of rotation of a shaft 15 that eccentrically extends through the compression chamber 11 and supports the vane 13. Between the vane 13 and the compression chamber 11, there is formed a sickle-shaped space that periodically increases and decreases as a result of the rotation of the vane 13, whereby a pumping effect is produced.

The compressed gas is transferred via a by-pass conduit 16 in a second pump stage 18 and is further compressed in a compression chamber 12 of the second stage 18 in which a vane 14 rotates. Finally, the gas is discharged.

The shaft 15 is driven by a motor that includes, in the embodiment shown in the drawings, permanent magnets 8 arranged on the shaft 15, and a stationary coil 7 that produces a rotatable magnetic field that sets the shaft 15 in rotation. A separation member 5 hermetically separates the coil 7 from the shaft 15. A control electronic 6 is connected with the coil 7 by electrical conductors, feeding current to the coil 7. The present invention is also applicable to vacuum pumps having other motors, e.g., an asynchronous motor.

A slide bearing 35 rotatably supports the shaft 15. The bearing 35 is located between the motor and the first stage 17. The shaft 15 is further supported by an end-side slide bearing 36 provided at the shaft end and located on a side of the second pump stage 18 remote from the first stage 17.

A lubricant pump is located between the first pump stage 17 and the motor. The lubricant pump includes a lubricant compression chamber 24 in which a vane 23 is rotatably supported. The rotation of the shaft 15 provides for rotation of the vane 23. In the drawings, a rectangular cross-section is shown. For manufacturing purposes, a circular cross-section is advantageous.

A lubricant flow resistance 34 is provided between the lubricant pump and the first stage 17. The object of the lubricant flow resistance 34 is to make the flow of the lubricant that leaves the lubricant pump under pressure, more difficult. It needs not to be completely prevented, a small flow should suffice for lubrication of the slide bearing 35. In the discussed embodiment, the lubricant flow resistance 34 is formed by a shaft shoulder formed by change of the shaft diameter. Additionally, a predetermined profile can be provided on the shaft surface, e.g., in form of grooves. According to advantageous modification, a helical groove is provided on the shaft that has a feeding direction opposite the flow direction of the lubricant.

The lubricant reservoir 30 is designed for receiving a large amount of lubricant. This lubricant forms, together with the lubricant in the compression chambers, bearings, and safety valve, a loop serving for lubricant exchange. A horizontal channel section 32*a* opens at its channel mouth 33 in the lubricant reservoir. After being subjected to the pressure in the lubricant reservoir, the lubricant exits the lubricant reservoir. This flow displaces the lubricant that was located in the lubricant reservoir, whereby a warm lubricant that was located in the vicinity of the pump stage housing 10 is displaced toward the pump stage housing 40 of the second stage 18, where the lubricant gives up its heat. This reduces the temperature of the lubricant, increasing its service life. The low temperature results in few chemical processes that can destroy the lubricant. The displacement of the lubricant is shown with a circular arrow.

Figure 2:
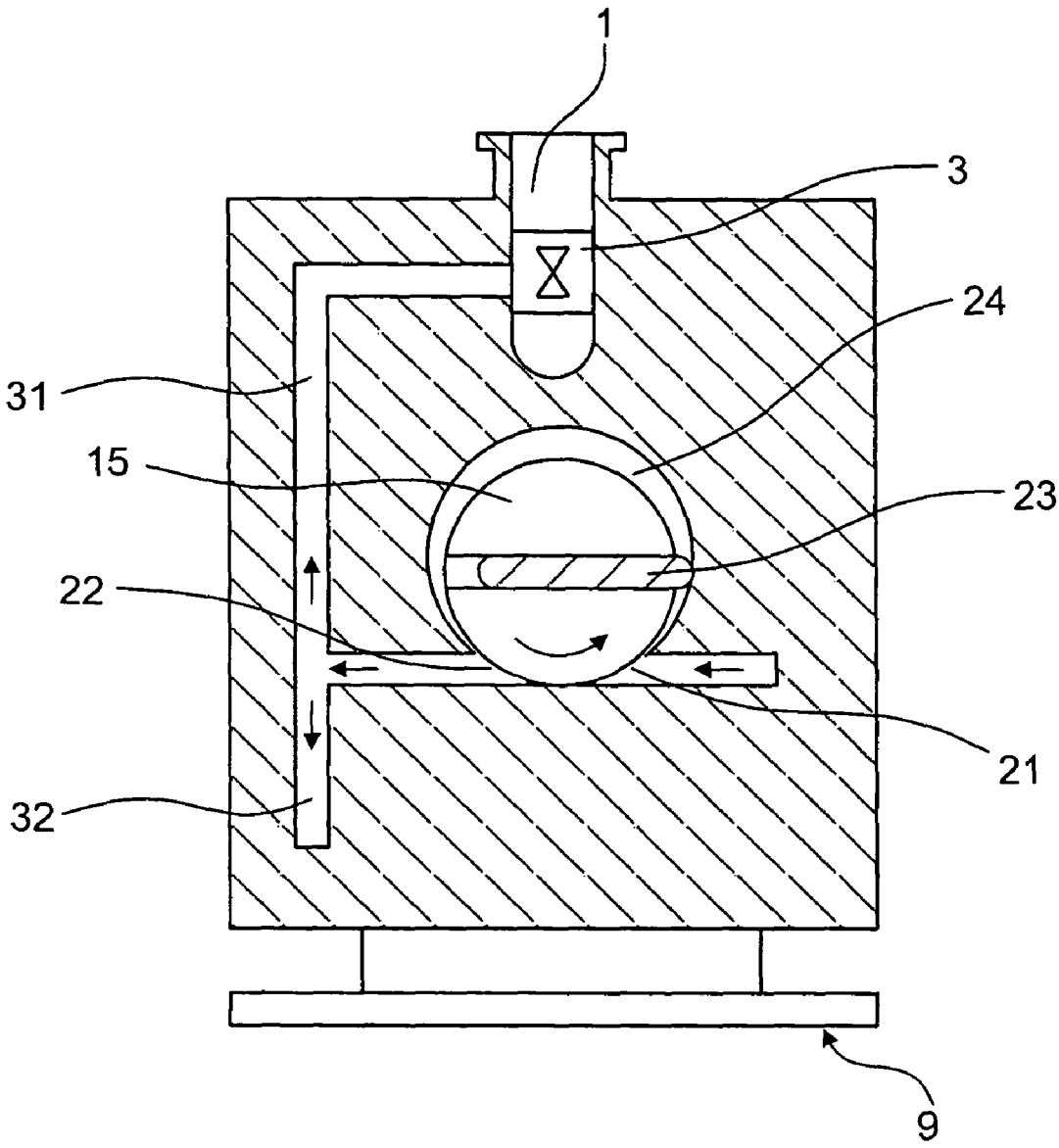
FIG. 2 a cross-sectional view of the inventive vacuum pump along line II-II in FIG. 1.

FIG. 2 shows a cross-sectional view at a height of the lubricant pump. The drawing shows the system of conduits through which the pressurized lubricant flows. The shaft 15 has a slot in which a vane 23 is displaceable. The vane 23, upon rotation the shaft 15, is pressed from the shaft axis radially outwardly by centrifugal forces. The shaft 15 extends eccentrically through the compression chamber 24. Upon rotation of the shaft 15, the space between the vane 23 and the wall is firstly increased, whereby the lubricant is aspirated through lubricant pump inlet 21. The lubricant is fed by the vane 23 circumferentially and is discharged through the outlet 22 of the lubricant pump into a hydraulic conduit 31 that connects the lubricant pump outlet 22 with the safety valve 3. A channel 32 branches from the hydraulic conduit 31, so that the pressurized lubricant is fed in both the hydraulic conduit 31 and the channel 32. The channel 32 is connected with the horizontal channel section 32*a*, as shown in FIG. 1. The outlet 22 of the lubricant pump lies on an adjusting surface 9 of the adjacent side of the shaft 15. With respect to the gravity force, the adjusting surface 9 is located beneath the wall axis. The channel section 32*a* opens into the lubricant reservoir 30 at a height between the shaft axis and the adjusting surface 9 of the vane rotary vacuum pump, which improves circulation of the lubricant in the reservoir 30.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A lubricant-tight vane rotary vacuum pump, comprising at least one pump stage (17, 18) having a pump stage housing (10, 40), a safety valve (3) for controlling gas flow to the pump stage housing; a lubricant pump having an inlet (21) and an outlet (22); a lubricant reservoir (30) at least partially surrounding the pump stage housing (10, 40); a hydraulic conduit (31) connecting the lubricant pump outlet (22) with the safety valve (3), with a pressurized lubricant flow through the hydraulic conduit (31) opening the safety valve (3); a channel (32) branching from the hydraulic conduit (31) for delivering a pressurized lubricant into the lubricant reservoir (30); a motor (7, 8); and a shaft (15) extending through the motor and the at least one pump stage (17, 18), wherein the lubricant pump is arranged on the shaft (15) between the motor and the at least one stage, and wherein the vane rotary vacuum pump has an adjusting surface (9), and the lubricant pump outlet (22) is located on a side of the shaft (15) adjacent to the adjusting surface (9).

2. A vane rotary vacuum pump according to claim 1, further comprising a lubricant flow resistance (34) located between the lubricant pump and the at least one pump stage (17 18).

3. A vane rotary vacuum pump according to claim 2, further comprising a slide bearing (35) for supporting the shaft (15) and located between the lubricant pump and the at least one stage (17, 18).

4. A vane rotary vacuum pump according to claim 1, wherein the branching channel (32) opens into the lubricant reservoir (30) at a height between the shaft axis and the adjusting surface (9).

* * * * *